US008381422B2

(12) United States Patent
Hill

(10) Patent No.: US 8,381,422 B2
(45) Date of Patent: Feb. 26, 2013

(54) METHOD AND MEANS FOR CONVERTING A BLADE ATTACHMENT OF AN OFF-ROAD VEHICLE TO A QUICK-ATTACH BLADE

(76) Inventor: Curt J. Hill, Warba, MN (US)

( * ) Notice: Subject to any disclaimer, the term of this patent is extended or adjusted under 35 U.S.C. 154(b) by 284 days.

(21) Appl. No.: 12/927,346

(22) Filed: Nov. 12, 2010

(65) Prior Publication Data

US 2012/0117833 A1 May 17, 2012

(51) Int. Cl.
*E01H 5/04* (2006.01)

(52) U.S. Cl. ..... 37/231; 172/817

(58) Field of Classification Search ..... 172/810, 172/811, 817; 37/231, 468
See application file for complete search history.

(56) References Cited

U.S. PATENT DOCUMENTS

| | | | | | |
|---|---|---|---|---|---|
| 2,883,776 | A | * | 4/1959 | Orscheln | 172/788 |
| 3,388,929 | A | * | 6/1968 | Miley | 280/481 |
| 3,410,008 | A | | 11/1968 | Standfuss | |
| 3,815,687 | A | | 6/1974 | Federspiel | |
| 4,658,519 | A | * | 4/1987 | Quenzi | 37/231 |
| 4,747,612 | A | | 5/1988 | Kuhn | |
| 4,778,195 | A | * | 10/1988 | Vachon | 280/477 |
| 4,962,598 | A | * | 10/1990 | Woolhiser et al. | 37/231 |
| 4,976,053 | A | | 12/1990 | Caley | |
| 5,075,988 | A | * | 12/1991 | Ciula | 37/231 |
| 5,082,389 | A | | 1/1992 | Balemi | |
| 5,141,385 | A | | 8/1992 | Tibbatts et al. | |
| 5,244,047 | A | | 9/1993 | Eudy | |
| 5,411,102 | A | * | 5/1995 | Nickels et al. | 172/781 |
| 5,485,690 | A | * | 1/1996 | MacQueen | 37/271 |
| 5,815,956 | A | | 10/1998 | Lavin et al. | |
| 5,909,960 | A | * | 6/1999 | Jager et al. | 37/235 |
| 5,960,569 | A | * | 10/1999 | Molstad | 37/231 |
| 6,009,642 | A | * | 1/2000 | Nugent | 37/231 |
| 6,138,770 | A | | 10/2000 | Kayser | |
| 6,145,222 | A | | 11/2000 | Curtis | |
| 6,170,178 | B1 | | 1/2001 | Christy | |
| 6,334,269 | B1 | * | 1/2002 | Dilks | 37/235 |
| RE37,628 | E | * | 4/2002 | Segorski et al. | 37/231 |
| 6,381,880 | B1 | * | 5/2002 | Curtis | 37/231 |
| 6,408,546 | B2 | * | 6/2002 | Curtis | 37/231 |
| 6,526,677 | B1 | * | 3/2003 | Bloxdorf et al. | 37/231 |
| 6,594,924 | B2 | * | 7/2003 | Curtis | 37/231 |
| 6,615,513 | B2 | | 9/2003 | Quenzi et al. | |
| 6,843,002 | B1 | | 1/2005 | Moffitt | |
| 6,928,757 | B2 | | 8/2005 | Bloxdorf et al. | |
| 6,957,505 | B1 | | 10/2005 | Moffitt | |
| 7,063,169 | B2 | * | 6/2006 | Elliott | 172/445.1 |
| 7,070,154 | B2 | * | 7/2006 | DiStaulo | 248/200 |
| 7,523,568 | B2 | * | 4/2009 | Willey | 37/231 |
| 7,703,222 | B2 | * | 4/2010 | Schmeichel | 37/232 |
| 7,963,052 | B2 | * | 6/2011 | Koch et al. | 37/231 |
| 8,220,560 | B1 | * | 7/2012 | Laudenklos | 172/272 |
| 2003/0019643 | A1 | * | 1/2003 | Pyle | 172/439 |
| 2004/0148811 | A1 | * | 8/2004 | Harris | 37/231 |
| 2006/0086008 | A1 | * | 4/2006 | Hubscher et al. | 37/231 |
| 2007/0084089 | A1 | * | 4/2007 | Shoemaker | 37/231 |
| 2008/0115391 | A1 | * | 5/2008 | Musso et al. | 37/231 |
| 2008/0115392 | A1 | * | 5/2008 | Musso et al. | 37/231 |
| 2008/0315556 | A1 | * | 12/2008 | Mikulas | 280/416.2 |
| 2009/0307938 | A1 | * | 12/2009 | Koch et al. | 37/231 |
| 2011/0277357 | A1 | * | 11/2011 | Schmeichel | 37/231 |

* cited by examiner

*Primary Examiner* — Jamie L McGowan
(74) *Attorney, Agent, or Firm* — Dennis L. Thomte; Thomte Patent Law Office LLC

(57) ABSTRACT

A quick-attach mechanism is provided for attachment to the forward end of push tubes which are secured to an off-road vehicle to enable a plow blade or other implement to be quickly attached to the forward ends of the push tubes.

9 Claims, 7 Drawing Sheets

METHOD AND MEANS FOR CONVERTING A BLADE ATTACHMENT OF AN OFF-ROAD VEHICLE TO A QUICK-ATTACH BLADE

BACKGROUND OF THE INVENTION

1. Field of the Invention

This invention relates to a quick-attach blade for an off-road vehicle such as an ATV or UTV. More particularly, this invention relates to a method and means for converting a conventional blade attachment of an off-road vehicle to a quick-attach blade.

2. Description of the Related Art

In recent years, it has become common to mount a plow blade on the forward end of an off-road vehicle such as an ATV or UTV. Most manufacturers utilize an elongated push tube assembly to mount the plow blade to the vehicle. In most prior art plow blades, the rearward ends of the push tube assembly are pivoted to the vehicle about a transverse horizontal axis to permit the forward end of the push tube assembly, and the plow blade secured thereto, to be raised and lowered. In some cases, the rearward ends of the push tubes of the push tube assembly are quickly attachable to the vehicle. Generally speaking, in most prior art plow blade attachment devices, a flat base plate is secured to the forward ends of the push tubes with a blade pivot or blade swivel assembly being horizontally pivotally mounted, about a vertical axis, to the base plate so that the angle of the blade may be selectively changed. The plow blade is hingedly secured to the blade pivot assembly so that the pitch of the plow blade may be changed and so that the upper end of the plow blade may pivot forwardly with respect to the blade pivot and so that the lower end of the plow blade may pivot rearwardly should the lower end of the plow blade strike an obstruction.

Although the blade attachments of the prior art perform satisfactorily, to the best of Applicant's knowledge, the blade pivot assemblies thereof are not quickly removably secured to the base plate of the push tube assembly. Thus, although the entire plow blade and its attachment structure may be fairly quickly attached to the vehicle, the push tube assembly cannot be used for any other purpose. Therefore, if other implements are to be mounted on the forward end of the vehicle, each of those implements must have a push tube assembly designed for the particular vehicle to which the implement is to be attached.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

The method of converting a blade attachment of an off-road vehicle to a quick-attach blade is disclosed with the blade attachment including a push tube assembly comprising a pair of longitudinally extending push tubes, having rearward and forward ends, which have their rearward ends pivotally secured to the vehicle about horizontal axes which are transverse to the longitudinal axis of the push tubes. The blade attachment also includes a generally horizontally disposed base plate which is secured to the push tubes at the forward ends thereof with a blade pivot assembly mounted on the base plate which is selectively pivotally secured thereto about a vertical axis, and a plow blade operatively hingedly secured to the blade pivot assembly for movement therewith. The method of this invention comprises the steps of:

(a) providing a rear adapter plate assembly including a generally horizontally disposed first mounting plate having a forward end, a rearward end, a first side, a second side and first and second horizontally spaced-apart elongated tubes secured thereto which extend forwardly from the forward end thereof;

(b) providing a front adapter plate assembly including a generally horizontally disposed second mounting plate having a forward end, a rearward end, a first side, a second side, and first and second horizontally spaced-apart elongated receiver tubes secured thereto which have open rearward ends;

(c) removing the blade pivot assembly and blade with the plow attached thereto from the base plate;

(d) securing the rear adapter plate assembly to the base plate so that the first mounting plate is positioned on the base plate;

(e) securing the blade pivot assembly to the second mounting plate so that the blade pivot assembly is positioned on the second mounting plate and so that the blade pivot assembly is selectively horizontally pivotally movable with respect thereto; and (f) the first and second tubes of the rear adapter plate being selectively received by the first and second receiver tubes so that the front adapter plate assembly, the blade pivot assembly and the blade may be quickly attached to the push tube assembly of the vehicle.

The apparatus of this invention is used in combination with an off-road vehicle such as an ATV, UTV, small tractor or a riding lawn mower having forward and rearward ends. An elongated push tube assembly is provided which has rearward and forward ends with the rearward end of the push tube assembly being pivotally secured about a horizontal axis, to the off-road vehicle so that the forward end of the push tube assembly is positioned forwardly of the forward end of the vehicle. A base plate is mounted on the forward end of the push tube assembly. A rear adapter plate assembly is provided which comprises a first flat plate having a forward end and a rearward end, and horizontally spaced-apart first and second elongated tubes, having rearward and forward ends, secured to the first flat plate and which extend forwardly therefrom. A front adapter plate assembly is also provided and is comprised of a second flat plate, having a forward end and a rearward end, and horizontally spaced-apart third and fourth elongated receiver tubes, having rearward and forward ends, secured to the second flat plate and extending rearwardly therefrom. The first and second tubes are selectively received by the third and fourth receiver tubes to selectively removably connect the front adapter plate to the rear adapter plate. The blade pivot assembly is positioned on the second plate and is selectively horizontally pivotally connected thereto about a vertical axis. The plow blade assembly is hingedly connected to the blade pivot assembly about a horizontal axis.

The forward end of the push tube assembly, the rear adapter plate assembly, the front adapter plate assembly, blade pivot assembly and plow blade are vertically movable by means of a winch on the forward end of the vehicle.

It is therefore a principal object of the invention to provide a method and means of converting a blade attachment of an off-road vehicle to a quick-attach blade.

A further object of the invention is to provide an apparatus mounted on the forward end of a push tube assembly secured to an off-road vehicle with the apparatus being able to be connected to a variety of different implements.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
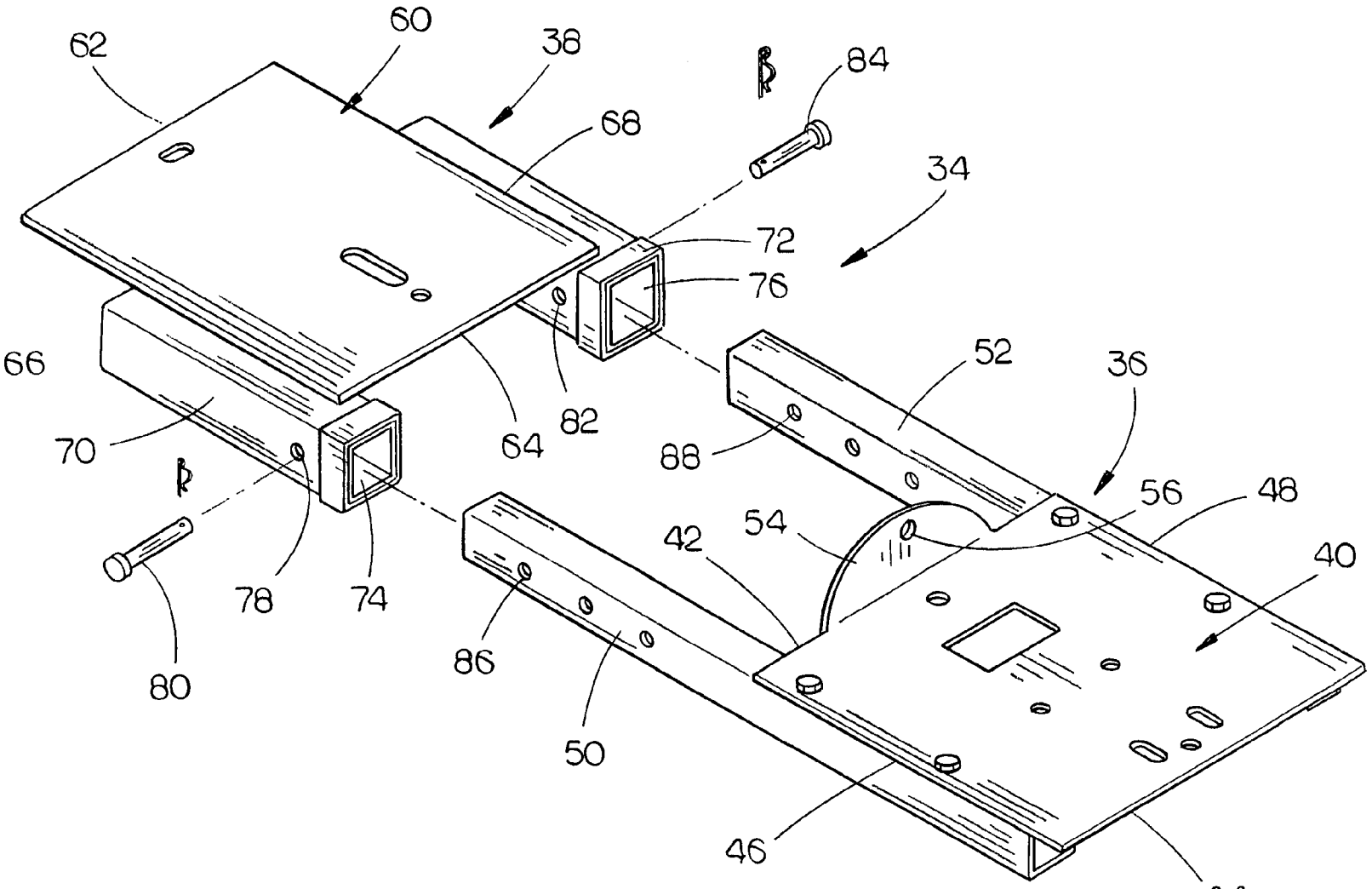
FIG. 1 is an exploded perspective view of the adapter assembly of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Although the invention hereof will work equally well with almost any type of plow blade, for ease of description only, the plow blade described and illustrated herein will be of the type manufactured by Moose Utility Division or RM.

In the drawings, the numeral 10 refers to a conventional off-road vehicle such as an ATV. The invention hereof may also be used on a UTV, small tractor or riding lawn mower. The vehicle 10 includes a forward end 12, a rearward end 14, a left side 16 and a right side 18. The numeral 20 refers to the blade attachment structure described above. Structure 20 includes an elongated push tube assembly 22, including push tubes 24 and 26. The rearward ends of push tubes 24 and 26 are pivotally secured to the vehicle rearwardly of the forward end thereof. The push tubes 24 and 26 are pivotally secured about horizontal axes to a mounting plate 27 secured to the underside of the vehicle. As shown, push tubes 24 and 26 converge from their rearward ends to their forward ends and are generally straight but the push tubes may be other than straight.

A base plate 28 is secured to the forward ends of the push tubes 24 and 26. A pivot hinge, hinge plate, blade swivel or blade pivot assembly 30 (hereinafter blade pivot assembly) is horizontally pivotally secured to base plate 28 about a vertical axis. Plow blade 32 is hingedly secured to blade pivot assembly 30 about a horizontal axis in conventional fashion to enable the pitch of the plow blade to be changed and to allow the blade to pivot should the blade strike an obstruction. The blade pivot assembly 30 is selectively pivotally movable in conventional fashion to change the angle of the plow blade 32. It is to this structure or similar structure of other manufacturers that the instant invention is utilized.

The adapter assembly of this invention is referred to generally by the reference numeral 34 and which includes a rear adapter assembly 36 and a front adapter assembly 38. Rear adapter assembly 36 includes a first generally flat mounting plate 40 having a forward end 42, a rearward end 44, a first side 46 and a second side 48. Plate 40 has first and second elongated tubes 50 and 52 secured thereto which extend forwardly therefrom in a parallel spaced-apart manner. A semi-circular plate 54 extends upwardly from the forward end 42 of plate 40. Plate 54 has an opening 56 formed therein.

Front adapter assembly 38 includes a second mounting plate 60 having a forward end 62, a rearward end 64, a first side 66 and a second side 68. Longitudinally extending receiver tubes 70 and 72 are secured to plate 60 at sides 66 and 68 thereof respectively and have open rearward ends 74 and 76 respectively. Plate 60 is provided with the necessary bolt openings formed therein which match the bolt openings in blade pivot assembly 30. Tubes 70 and 72 are sized to receive tubes 50 and 52 therein respectively. Tube 70 has a through opening 78 formed therein adapted to receive lock pin 80. Tube 72 has a through opening formed therein adapted to receive lock pin 84.

Tube 50 has a plurality of spaced-apart openings 86 formed therein adapted to receive lock pin 80. Tube 52 has a plurality of spaced-apart openings 88 formed therein which are adapted to receive lock pin 84.

Vehicle 10 includes a winch 90 at the forward end thereof which has a winch cable 92 extending therefrom in conventional fashion.

Figure 2:
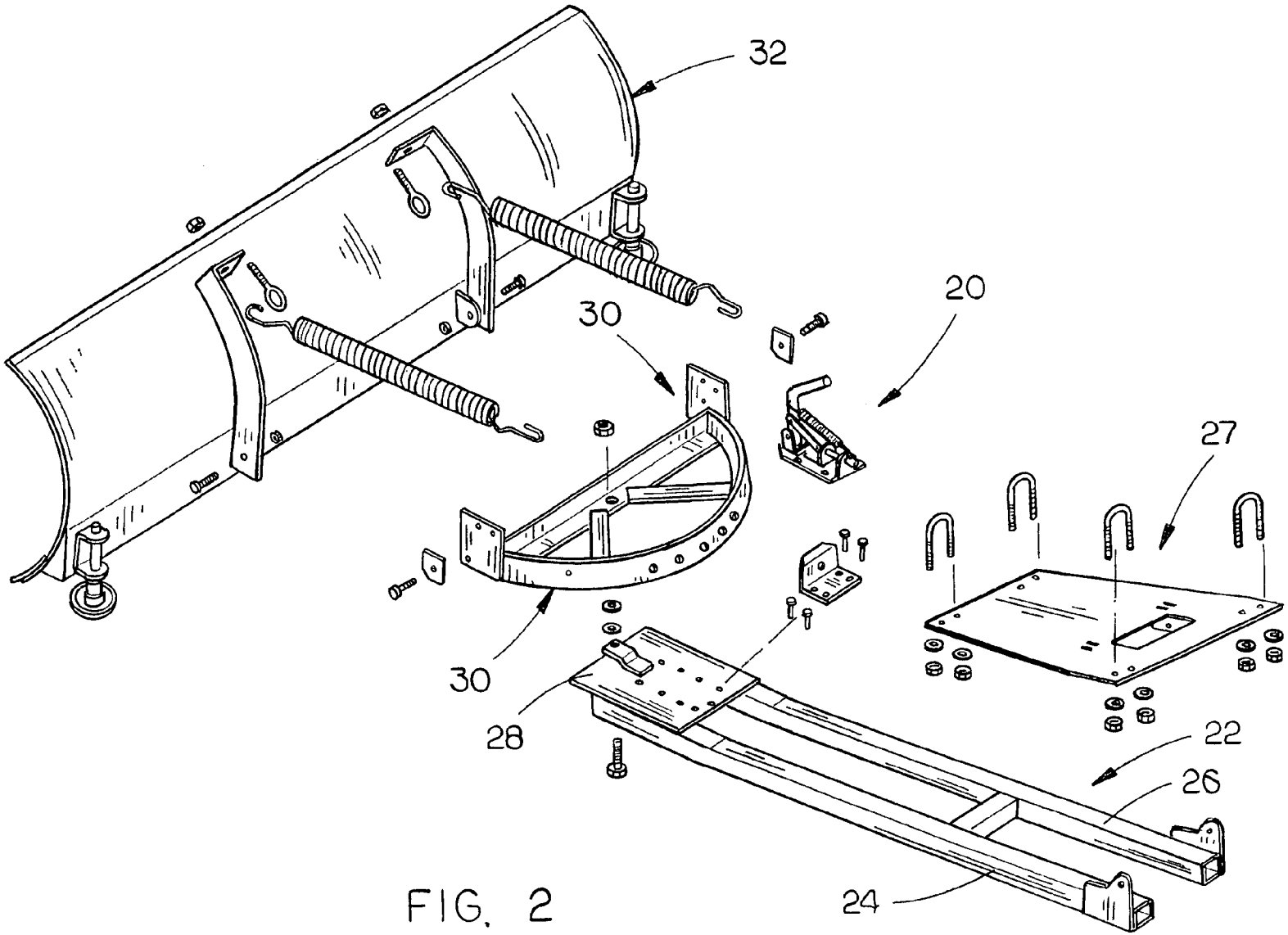
FIG. 2 is an exploded perspective view of a prior art blade attachment.
Figure 3:
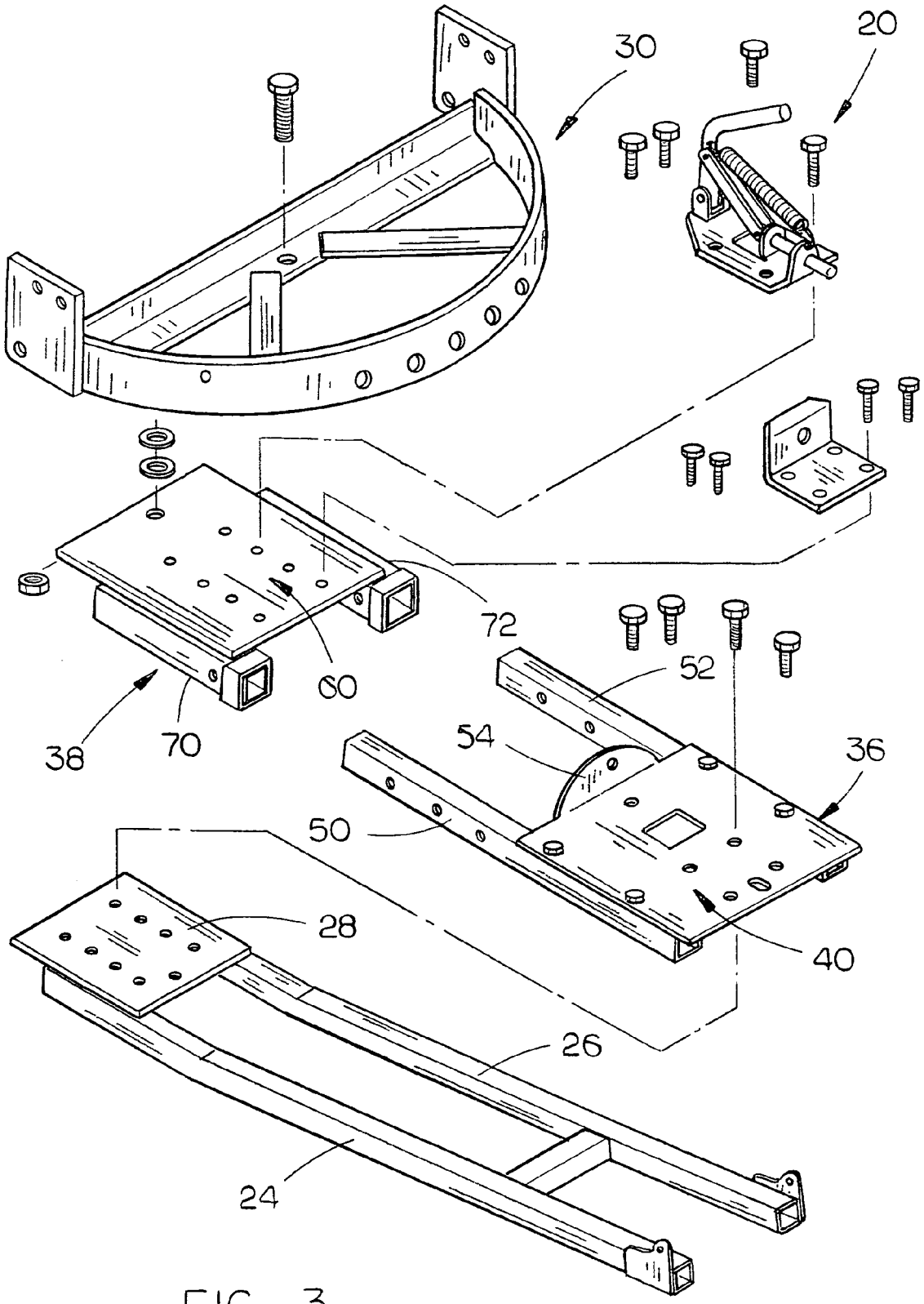
FIG. 3 is an exploded perspective view of the adapter plate assembly of this invention and its relationship to the prior art blade attachment assembly.
Figure 4:
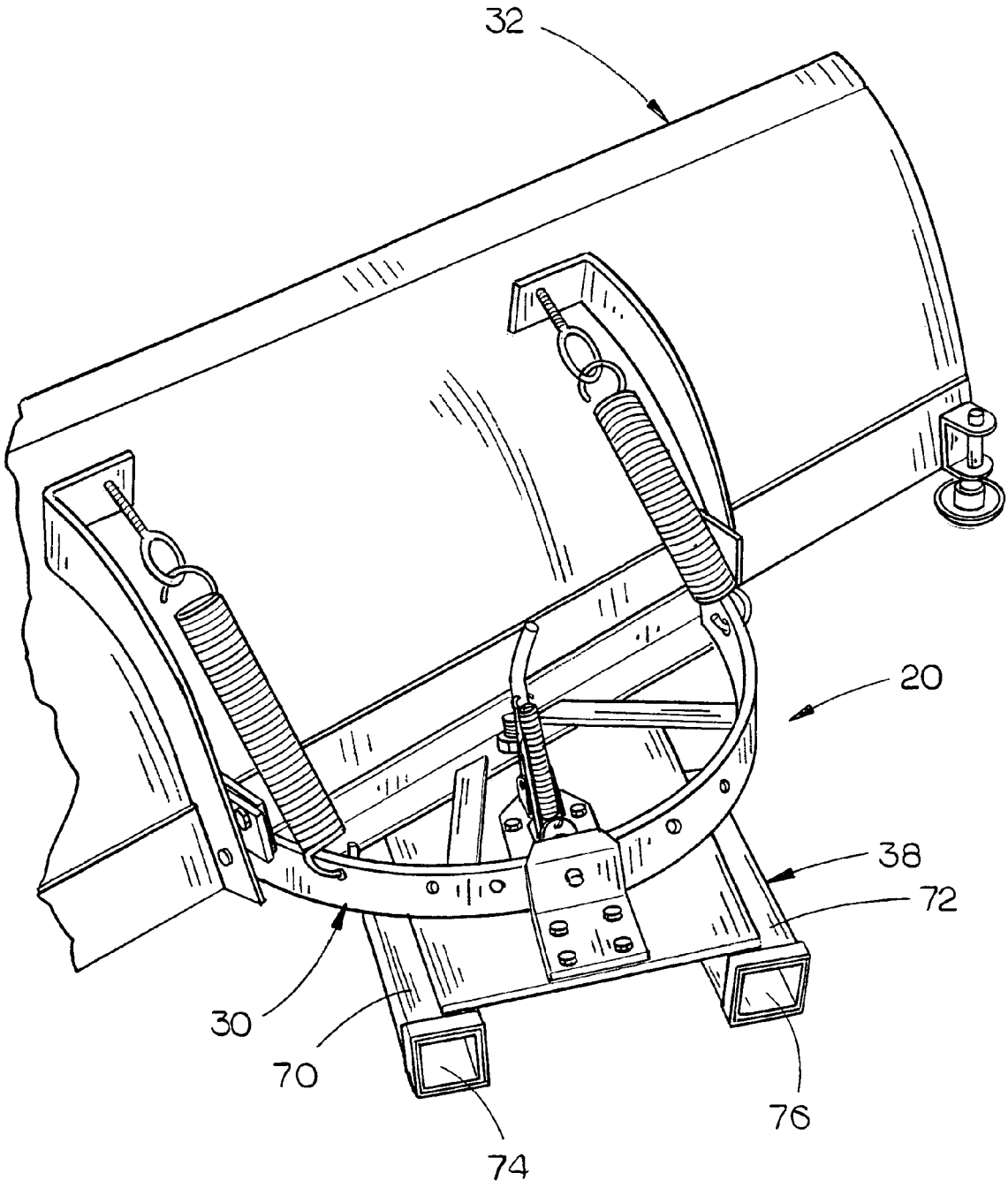
FIG. 4 is a rear perspective view of the blade attachment of the prior art mounted on the front adapter plate of the adapter plate assembly of this invention.
Figure 5:
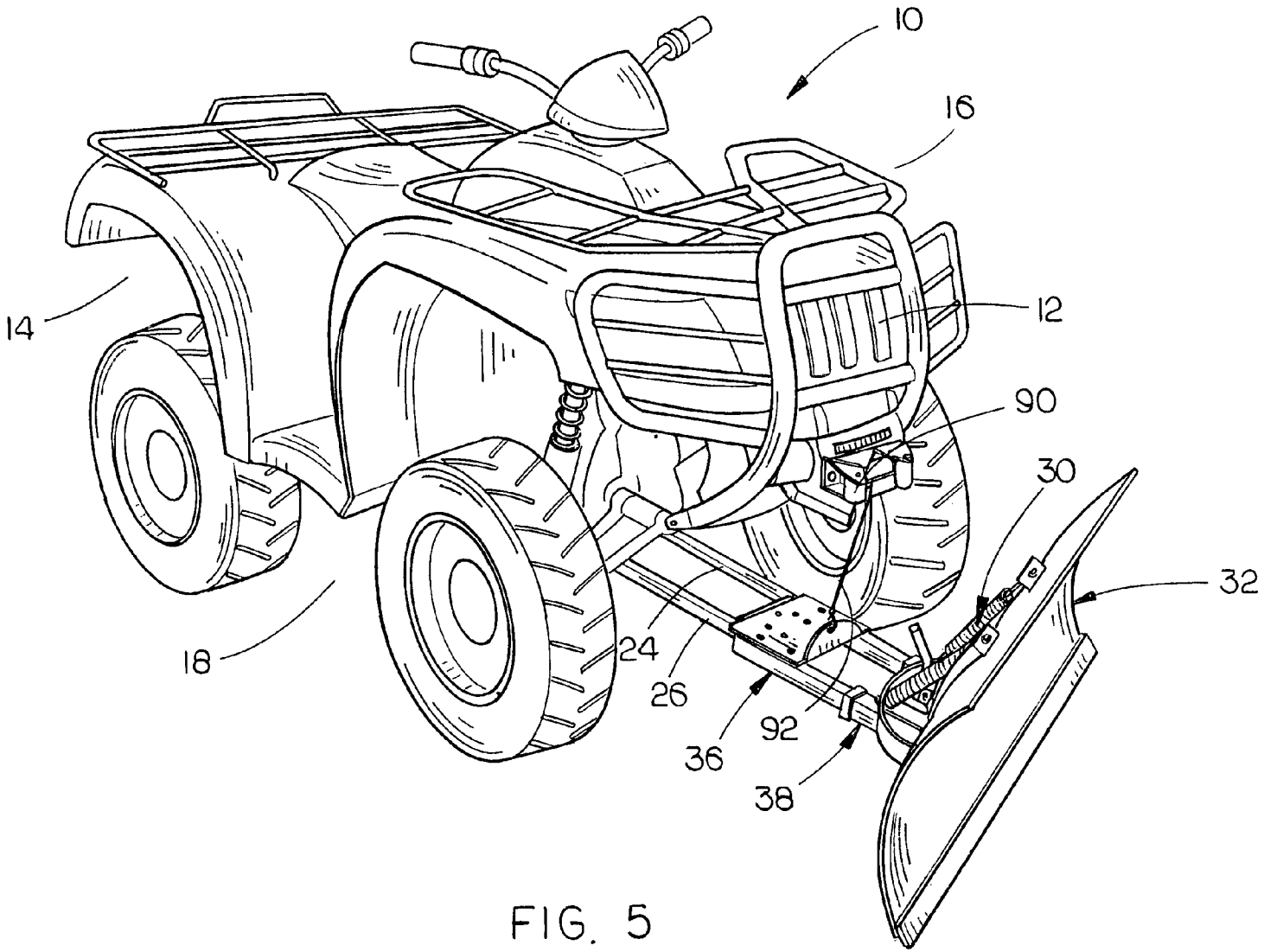
FIG. 5 is a front perspective view illustrating the adapter plate assembly of this invention mounted on the forward end of an off-road vehicle.

In use, assuming that the blade attachment 20, as illustrated in FIG. 2, is attached to the vehicle 10 as described, the blade pivot assembly 30 is removed from the forward ends of the push arms 24 and 26 without disconnecting the blade 32 from the structure 20. The rear adapter assembly 36 is then secured to the plate 26 by bolts so that the plate 40 is positioned above the plate 28 with the tubes 50 and 52 extending forwardly therefrom. The blade pivot assembly 30 is then secured to plate 60 of front adapter assembly 38 by bolts as illustrated in FIG. 4.

When it is desired to connect the blade 32 and its blade attachment assembly 30 to the vehicle, the vehicle is driven forwardly so that the tubes 50 and 52 are received within the receiver tubes 70 and 72. Lock pins 80 and 84 are then inserted through the openings 78 and 82 respectively for reception within one of the openings 86 and 88 of tubes 50 and 52 respectively. If not already done so, the end of winch cable 92 will be connected to the semi-circular plate 54 by way of the opening 56. Thus, the blade 32 may be raised or lowered with respect to the forward end of the vehicle through the actuation of the winch 90.

It can therefore be seen that a novel apparatus has been provided which enables the conventional push tube assembly of an off-road vehicle to be connected to an implement such as the blade 32 in a quick-attach manner.

Figure 6:
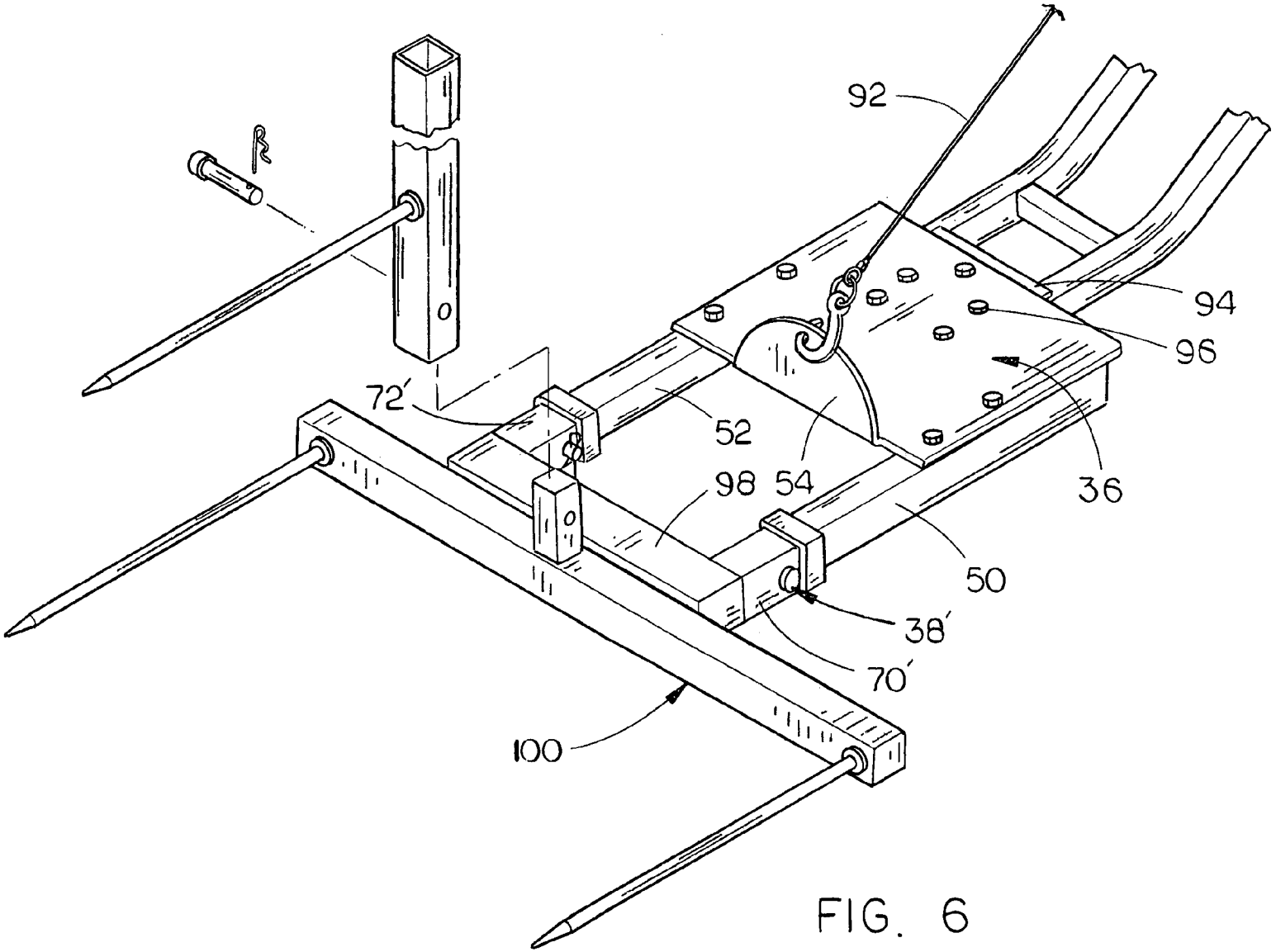
FIG. 6 is a front perspective view illustrating a modified form of the invention which is used to support an implement other than a blade at the forward end of a pair of push arms.

FIG. 6 illustrates how a modified form of the adapter assembly of this invention may be used for attaching an implement, other than the plow blade, to the forward end of the vehicle. The rear adapter assembly 36 is mounted on the base plate 28 which is secured to the forward ends of push tubes 96 and 98 which are curved rather than the straight push tubes 24 and 26. The front adapter assembly 38' is somewhat different than the front adapter assembly 38 previously described. The receiver tubes 70' and 72' are somewhat shorter than the receiver tubes 70 and 72. The forward ends of receiver tubes 70' and 72' have a cross-member 98 secured thereto which extends therebetween. A bale spear assembly 100 is secured to the cross-member 98 so that the vehicle may move hay bales or the like.

Thus it can be seen that implements other than the plow blade 32 may be quickly and easily attached to the forward end of the push arm assembly 22 without providing a separate push tube assembly 22 for each implement desired to be attached to the forward end of the push arm assembly.

Figure 7:
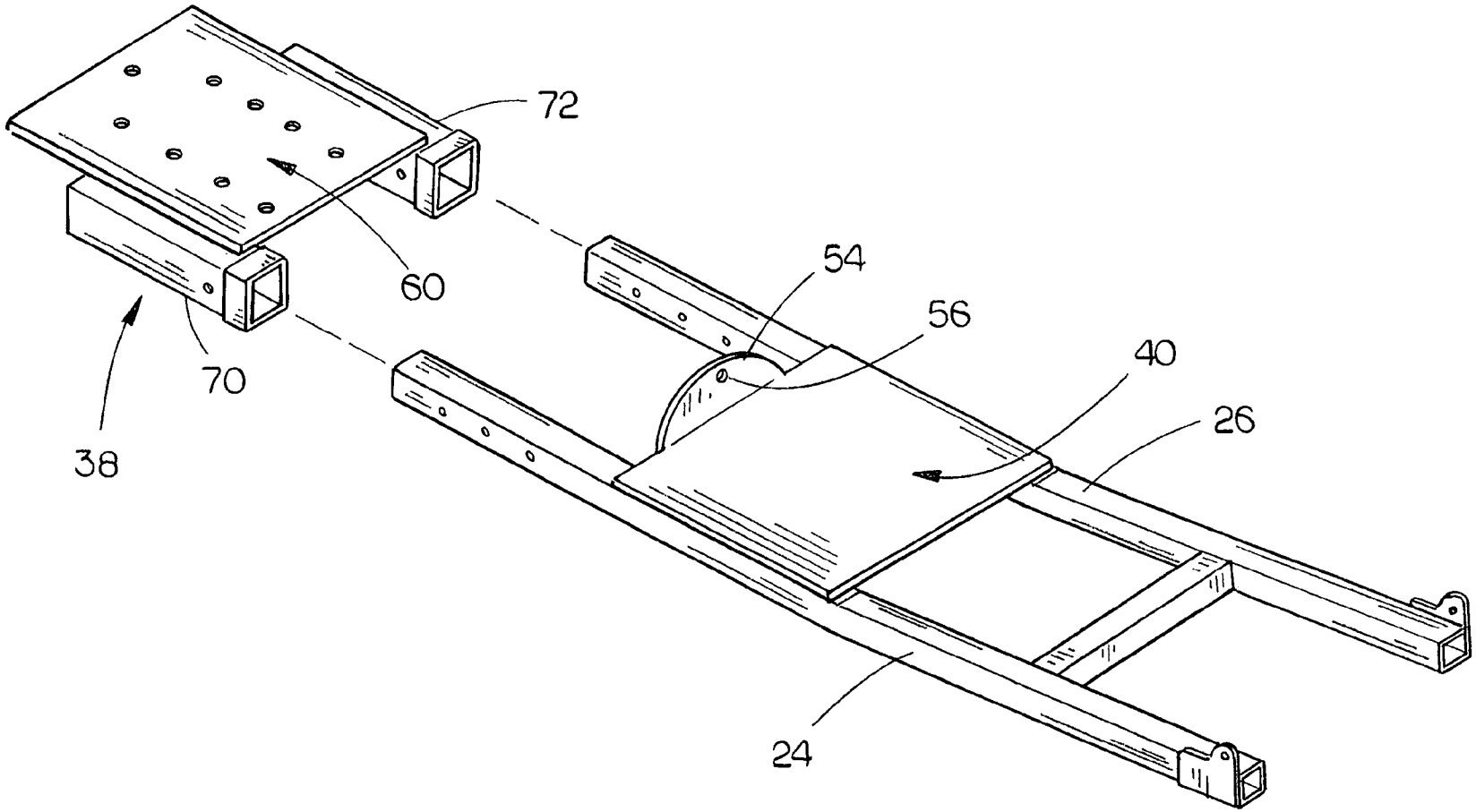
FIG. 7 is an exploded perspective view of a modified form of the invention.

In some cases, the rear adapter assembly may not be necessary if the forward ends of the push tubes 24 and 26 are selectively removably received by the first and second receiver tubes 70 and 72 as seen in FIG. 7. In that case, a base plate at the forward ends of the push tubes may not be necessary. However, in that case, a plate such as plate 54 with a hook hole 56 would be secured to the push tubes 24 and 26 to enable the push tubes to be raised and lowered by means of a winch.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. The method of converting a blade attachment of an off-road vehicle to a quick-attach blade wherein the blade attachment includes a push tube assembly comprising a pair of longitudinally extending push tubes, having rearward and forward ends, which have their rearward ends pivotally secured to the vehicle about horizontal axes which are transverse to the longitudinal axis of the push tubes, a generally horizontally disposed base plate secured to the push tubes at the forward ends thereof, a blade pivot mounted on the base plate and being selectively pivotally secured thereto about a vertical axis, and a plow blade operatively hingedly secured to the blade pivot for movement therewith, comprising the steps of:

providing a rear adapter assembly including a generally horizontally disposed first mounting plate having a forward end, a rearward end, a first side, a second side and first and second horizontally spaced-apart elongated tubes secured thereto which extend forwardly from the forward end thereof;

providing a front adapter assembly including a generally horizontally disposed second mounting plate having a forward end, a rearward end, a first side, a second side, and first and second horizontally spaced-apart elongated receiver tubes secured thereto which extend rearwardly therefrom and which have open rearward ends;

removing the blade pivot and blade from the base plate;

securing the rear adapter assembly to the base plate so that the first mounting plate is positioned on the base plate;

securing the blade pivot to the second mounting plate so that the blade pivot is positioned on the second mounting plate and so that the blade pivot is selectively horizontally pivotally movable with respect thereto;

the first and second tubes of the rear adapter assembly being adapted to be selectively received by the first and second receiver tubes so that the front adapter assembly, the blade pivot and the blade may be quickly attached to the push tube assembly of the vehicle.

2. The method of claim 1 wherein the off-road vehicle is an all-terrain vehicle.

3. The method of claim 1 wherein the off-road vehicle is a UTV.

4. The method of claim 1 wherein the off-road vehicle is a small tractor.

5. The method of claim 1 wherein the off-road vehicle is a riding lawn mower.

6. The method of claim 1 further including the step of providing a winch which is secured to the vehicle and which has a winch cable and further including the step of securing the winch cable to the rear adapter assembly.

7. In combination with an off-road vehicle having forward and rearward ends;

an elongated push tube assembly having rearward and forward ends;

said rearward end of said push tube assembly being secured to the off-road vehicle so that the forward end of said use tube assembly is positioned at the forward end of the vehicle;

a base plate mounted on said forward end of said push tube assembly;

a rear adapter assembly comprising a first mounting plate having a forward end and a rearward end, and horizontally spaced-apart first and second elongated tubes, having rearward and forward ends, secured to said first mounting plate and extending forwardly therefrom;

a front adapter assembly comprising a second mounting plate, having a forward end and a rearward end, and horizontally spaced apart first and second elongated receiver tubes, having rearward and forward ends, secured to said second mounting plate and extending rearwardly therefrom;

said first and second tubes being selectively received by said first and second receiver tubes to selectively removably conned said front adapter assembly to said rear adapter assembly;

a blade pivot positioned on said second mounting plate which is selectively horizontally pivotally connected thereto about a vertical axis;

and a plow blade assembly hingedly connected to said blade pivot about a horizontal axis.

8. The combination of claim 7 wherein said rearward end of said push tube assembly is pivotally secured to the vehicle about a horizontal axis transverse to the longitudinal axis of said push tube assembly, and wherein a winch is secured to the forward end of the vehicle and which has a winch cable extending therefrom which is connected to said rear adapter assembly for raising and lowering the same.

9. The combination of claim 7 further including means for selectively preventing the separation of said first and second receiver tubes with respect to said first and second tubes.

* * * * *